US012385368B2

(12) United States Patent
Langlais

(10) Patent No.: US 12,385,368 B2
(45) Date of Patent: Aug. 12, 2025

(54) SHROUD-EMBEDDED CONTROL LINE CLAMP

(71) Applicant: SCHLUMBERGER TECHNOLOGY CORPORATION, Sugar Land, TX (US)

(72) Inventor: Michael Dean Langlais, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/682,979

(22) PCT Filed: Aug. 30, 2022

(86) PCT No.: PCT/US2022/042030
§ 371 (c)(1),
(2) Date: Feb. 12, 2024

(87) PCT Pub. No.: WO2023/043611
PCT Pub. Date: Mar. 23, 2023

(65) Prior Publication Data

US 2024/0426195 A1 Dec. 26, 2024

Related U.S. Application Data

(60) Provisional application No. 63/261,303, filed on Sep. 17, 2021.

(51) Int. Cl.
*E21B 43/10* (2006.01)
*E21B 43/08* (2006.01)

(52) U.S. Cl.
CPC ..... *E21B 43/10* (2013.01); *E21B 43/08* (2013.01)

(58) Field of Classification Search
CPC ..... E21B 43/10; E21B 43/08; E21B 17/1035; E21B 17/026
See application file for complete search history.

(56) References Cited

U.S. PATENT DOCUMENTS 5,379,836 A * 1/1995 Jordan ..... E21B 17/1035 166/241.6
6,023,027 A * 2/2000 Neff ..... E21B 17/1035 174/136
6,681,854 B2 1/2004 Danos
6,805,202 B2 10/2004 Gillespie
10,197,190 B1 * 2/2019 Neff ..... E21B 17/1035
(Continued)

FOREIGN PATENT DOCUMENTS

EP 0125015 A1 11/1984

OTHER PUBLICATIONS

Search Report and Written Opinion of International Patent Application No. PCT/US2022/042030 issued on Dec. 13, 2022; 9 pages.

*Primary Examiner* — Steven A MacDonald
(74) *Attorney, Agent, or Firm* — Jeffrey D. Frantz

(57) ABSTRACT

A sand screen joint for use with a control line. The sand screen joint may include a shroud having a channel extending longitudinally across the shroud and a control line clamp coupled to the shroud. The control line clamp may include a base having a profile that aligns with the channel of the shroud and a lid that engages with the base to retain the lid in a closed position and to retain the control line within the control line clamp.

17 Claims, 7 Drawing Sheets

(56) References Cited

U.S. PATENT DOCUMENTS

| | | | | |
|---|---|---|---|---|
| 12,098,598 | B2 * | 9/2024 | Ortiz | E21B 17/026 |
| 12,215,805 | B2 * | 2/2025 | Gill | B63B 21/27 |
| 2010/0018697 | A1 * | 1/2010 | Richards | E21B 43/08 166/227 |
| 2011/0297376 | A1 | 12/2011 | Holderman | |
| 2017/0260815 | A1 | 9/2017 | Levie | |
| 2022/0195816 | A1 * | 6/2022 | Bardo | F16L 33/035 |
| 2023/0039223 | A1 * | 2/2023 | Ortiz | F16B 7/182 |
| 2023/0110686 | A1 * | 4/2023 | Gill | E21B 17/02 405/172 |
| 2023/0295990 | A1 * | 9/2023 | Vannetzel | E21B 17/026 166/242.6 |

* cited by examiner

SHROUD-EMBEDDED CONTROL LINE CLAMP

CROSS-REFERENCE TO RELATED APPLICATIONS

This application is the National Stage Entry of International Application No. PCT/US2022/042030, filed Aug. 30, 2022, which claims the benefit of U.S. Provisional Application No. 63/261,303 entitled "Shroud-Embedded Control Line Clamp," filed Sep. 17, 2021, the disclosure of which is incorporated herein by reference in its entirety.

BACKGROUND

In many oil and gas well applications, a borehole is drilled into the earth and subsequently completed with equipment, i.e. a completion, to facilitate production of desired fluids from a reservoir. The completion may comprise various types of sand control equipment, e.g. sand screen filters, which block the inflow of sand as the oil and/or gas flow into the completion.

The completion may be assembled by connecting sand screen joints and deploying the sand screen joints downhole into the wellbore to a desired well zone. In a variety of applications, the wellbore may comprise multiple well zones and several sand screen joints may be disposed along each of the well zones. Within each well zone, the individual sand screen joints may comprise inflow ports through which the well fluid flows into the interior of the completion equipment for production to the surface.

Additionally, control lines may be run along the completion from the surface to the toe of the well. While the control lines may be clamped to some sections of the completion, the control lines positioned within channels formed in or coupled to sand screens or shrouds of the sand screen joints to prevent damage to the control lines. Accordingly, it is necessary to retain the control lines within the channels of the sand screen joints.

SUMMARY

A sand screen joint for use with a control line according to one or more embodiments of the present disclosure includes a shroud having a channel extending longitudinally across the shroud and a control line clamp coupled to the shroud. The control line clamp includes a base having a profile that aligns with the channel of the shroud and a lid that engages with the base to retain the lid in a closed position and to retain the control line within the control line clamp.

A completion system according to one or more embodiments of the present disclosure includes a control line and a sand screen joint. The sand screen joint includes a shroud having a channel extending longitudinally across the shroud and a control line clamp coupled to the shroud. The control line clamp includes a base having a profile that aligns with the channel of the shroud and a lid that engages with the base to retain the lid in a closed position and to retain the control line within the control line clamp.

A method for completing a well according to one or more embodiments of the present disclosure includes positioning a control line within a channel of a shroud of a sand screen joint. The method also includes positioning the control line within a base of a control line clamp, the base having a profile that aligns with the channel of the shroud. The method further includes rotating a lid of the control line clamp to a closed position to retain the control line within the control line clamp, wherein the lid engages with the base to retain the lid in a closed position. The method also includes running a completion comprising the sand screen joint into the well.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various described technologies. The drawings are as follows.

DETAILED DESCRIPTION

In the following description, numerous details are set forth to provide an understanding of some embodiments of the present disclosure. However, it will be understood by those of ordinary skill in the art that that embodiments of the present disclosure may be practiced without these details and that numerous variations or modifications from the described embodiments may be possible.

In the specification and appended claims: the terms "connect," "connection," "connected," "in connection with," "connecting," "couple," "coupled," "coupled with," and "coupling" are used to mean "in direct connection with" or "in connection with via another element." As used herein, the terms "up" and "down," "upper" and "lower," "upwardly" and "downwardly," "upstream" and "downstream," "uphole" and "downhole," "above" and "below," and other like terms indicating relative positions above or below a given point or element are used in this description to more clearly describe some embodiments of the disclosure.

Figure 1:
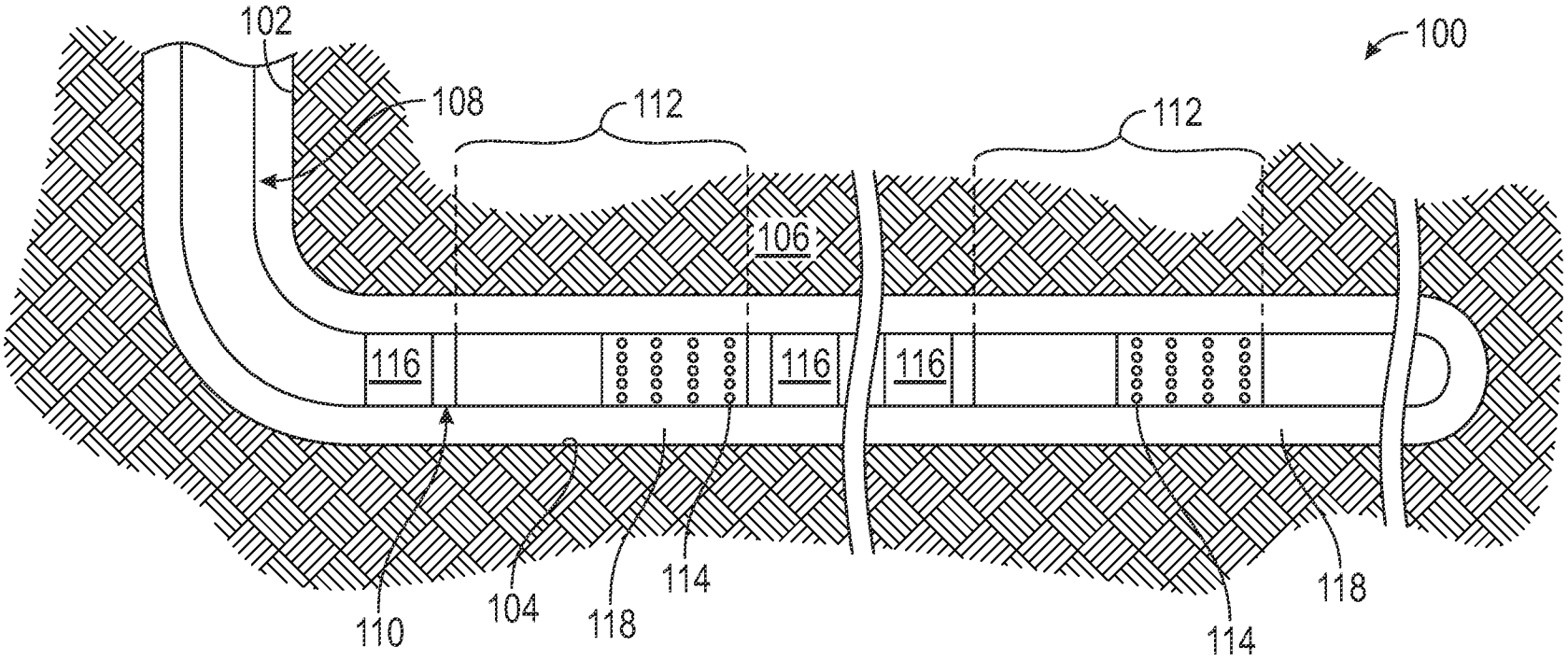
FIG. 1 is a schematic view of a well system according to one or more embodiments of the present disclosure.

Referring now to FIG. 1, FIG. 1 is a well system 100 that includes a wellbore 102 having a deviated wellbore section 104 extending into a formation 106 containing hydrocarbon fluids. Depending on the application, the wellbore 102 may comprise one or more deviated wellbore sections 104, e.g. horizontal wellbore sections, which may be cased or uncased. In the example illustrated, a tubing string 108 is deployed downhole into wellbore 102 and comprises a downhole well completion 110 deployed in the deviated, e.g. horizontal, wellbore section 104.

The downhole well completion 110 may be constructed to facilitate production of well fluids and/or injection of fluids. By way of example, the downhole well completion 110 may comprise at least one sand screen joint 112, e.g. a plurality of screen assemblies 112. Each sand screen joint 112 may include a shroud, e.g. a sand screen, 114 that cover a screen filter through which fluid may enter the corresponding sand screen joint 112 for production to a suitable location, e.g. a surface location. For example, hydrocarbon well fluids may flow from formation 106, into wellbore 102, and into the screen assemblies 112 via the shrouds 114. In some embodiments, the downhole well completion 110 also may comprise a plurality of packers 116 which may be used to isolate sections or zones 118 along the wellbore 102.

Figure 2:
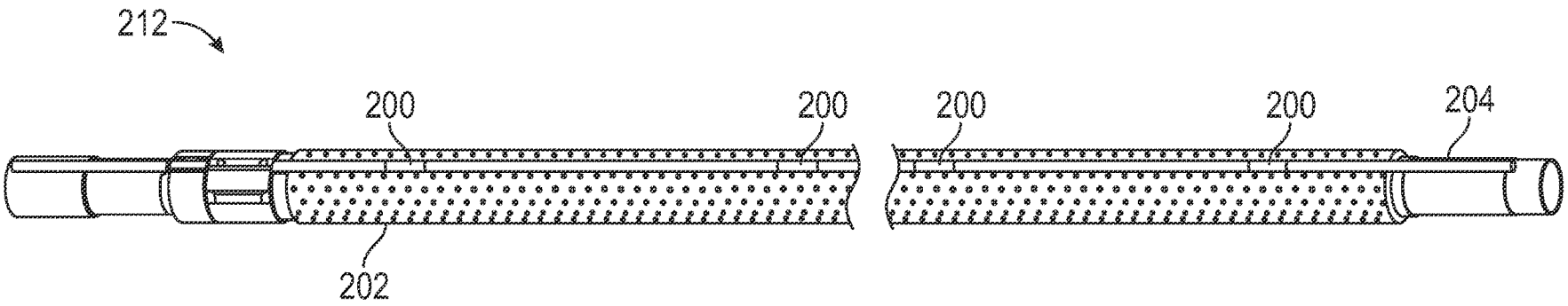
FIG. 2 is a sand screen joint according to one or more embodiments of the present disclosure.

Turning now to FIG. 2, FIG. 2 is a sand screen joint 212, according to one or more embodiments of the present disclosure. The sand screen joint 212 includes control line clamps 200 embedded in the shroud 202 of the sand screen joint 212. The control line clamps 200 retain control lines 204 (e.g., conduits for electrical wires, hydraulic fluid, or fiber optic lines) in a channel of the shroud, shown more clearly below in FIG. 2, to prevent the control lines 204 from protruding outside of the shroud 202. Additionally, as described in more detail below, the control line clamps 200 may support at least a portion of the weight of the control lines 204 and/or reduce axial movement of the control lines 204.

Figure 3:
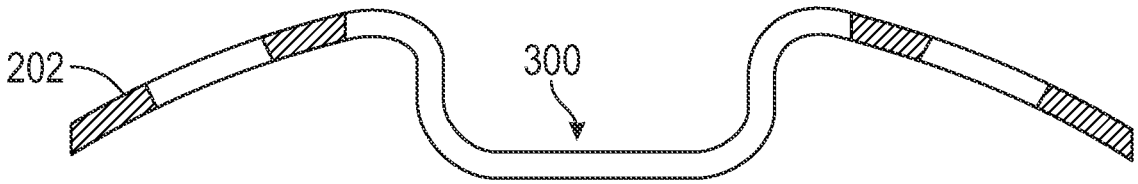
FIG. 3 is a partial, cross-sectional view of a shroud according to one or more embodiments of the present disclosure.
Figure 4:
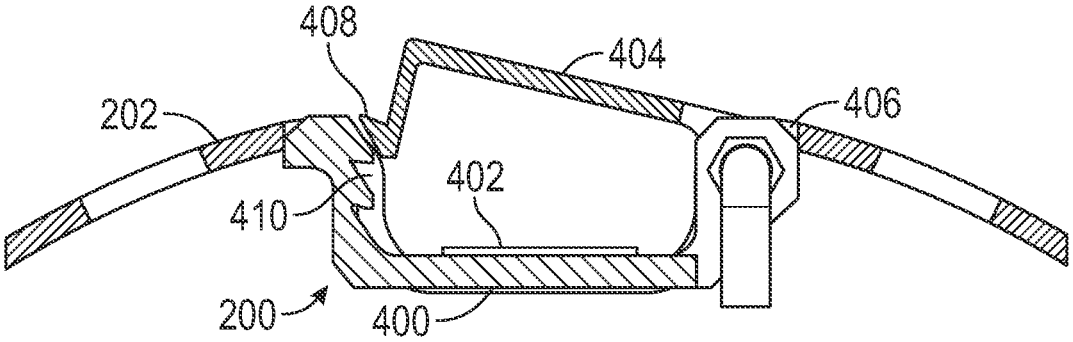
FIG. 4 is a partial, cross-sectional view of a shroud according to one or more embodiments of the present disclosure.

Turning now to FIGS. 3 and 4, FIGS. 3 and 4 are partial, cross-sectional views of a shroud 202 of FIG. 2. As discussed above, the shroud 202 includes a channel 300 that extends longitudinally across the shroud 202 to allow control lines 204 to pass across the sand screen joint 212 to areas of the wellbore that are downhole of the sand screen joint 212. In one or more embodiments of the present disclosure, the control line clamps 200 are coupled to the shroud 202 via removing a portion of the shroud 202 and welding the control line clamp 200 in place of the removed portion of the shroud 202. In other embodiments, the control line clamps 200 may be sized to be positioned within the channel 300 and are welded, bolted, or otherwise coupled to the shroud 202 once positioned within the channel 300.

As shown in FIG. 4 the include a base 400 that has profile that aligns with the channel 300 of the shroud 202, shown in FIG. 3, to allow the control lines 204 to pass across the control line clamps 200. The base 400 may also include a tooth profile 402 that engages with the control lines 204 or a material coupled to and/or surrounding the control lines 204 when the lid 404 is closed to support at least a portion of the weight of the control lines 204 and/or reduce axial movement of the control lines 204. Further, supporting at least a portion of the weight of the control lines 204 via the control line clamps 200 also reduces axial sag of the control lines, which, if left unaddressed, may cause the control lines 204 to extend outside of the channel. The control line clamps also include a lid 404 having a hinged edge portion 406 that is rotatingly coupled to the base 400 and a toothed edge portion 408 that engages with a ratchet profile 410 formed in the base 400 to retain the lid 404 in a closed position.

Figure 5:
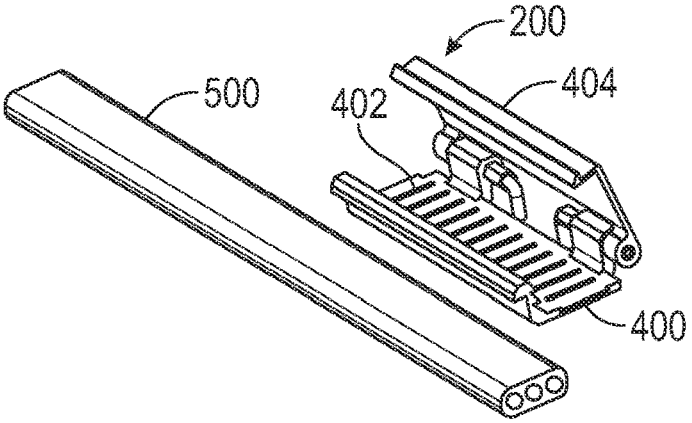
FIG. 5 is an isometric view of the clamp of FIG. 4 prior to the control line being installed.
Figure 6:
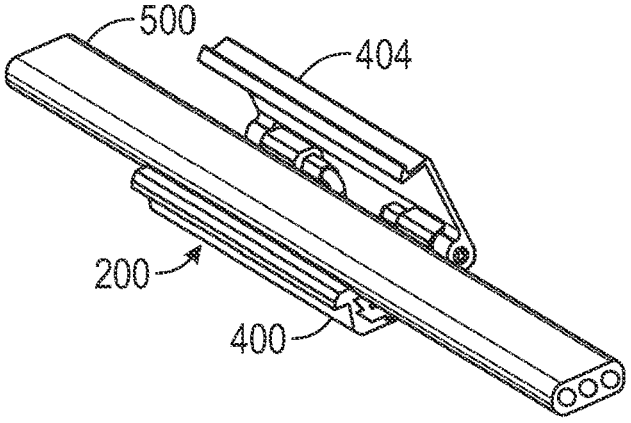
FIG. 6 is an isometric view of the clamp of FIG. 4 with the control line installed.
Figure 7:
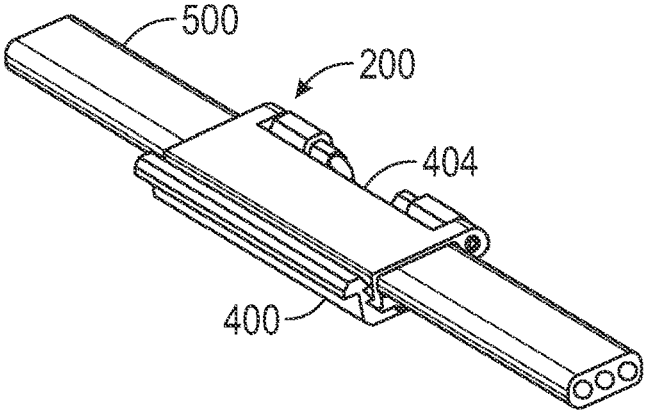
FIG. 7 is an isometric view of the clamp of FIG. 4 in the closed position.

Turning now to FIGS. 5-7, in operation, control lines 204, shown within plastic encapsulation 500, are positioned within the control line clamp and the lid 404 is rotated to a closed position, shown in FIG. 7, to retain the control lines 204 within the plastic encapsulation 500 within the control line clamp 200, thereby retaining the control lines 204 within the channel 300. Additionally, the tooth profile 402 engages with the plastic encapsulation 500 when the lid 404 is closed to support at least a portion of the weight of the control lines and encapsulation 500 and/or reduce axial movement of the control lines and encapsulation 500. In one or more embodiments, the control line clamps 200 are spaced between approximately 4 feet and approximately 8 feet apart. In other embodiments, the control line clamps 200 may be closer than approximately 4 feet apart or further than 8 feet apart, depending on the requirements of the system.

Figure 8:
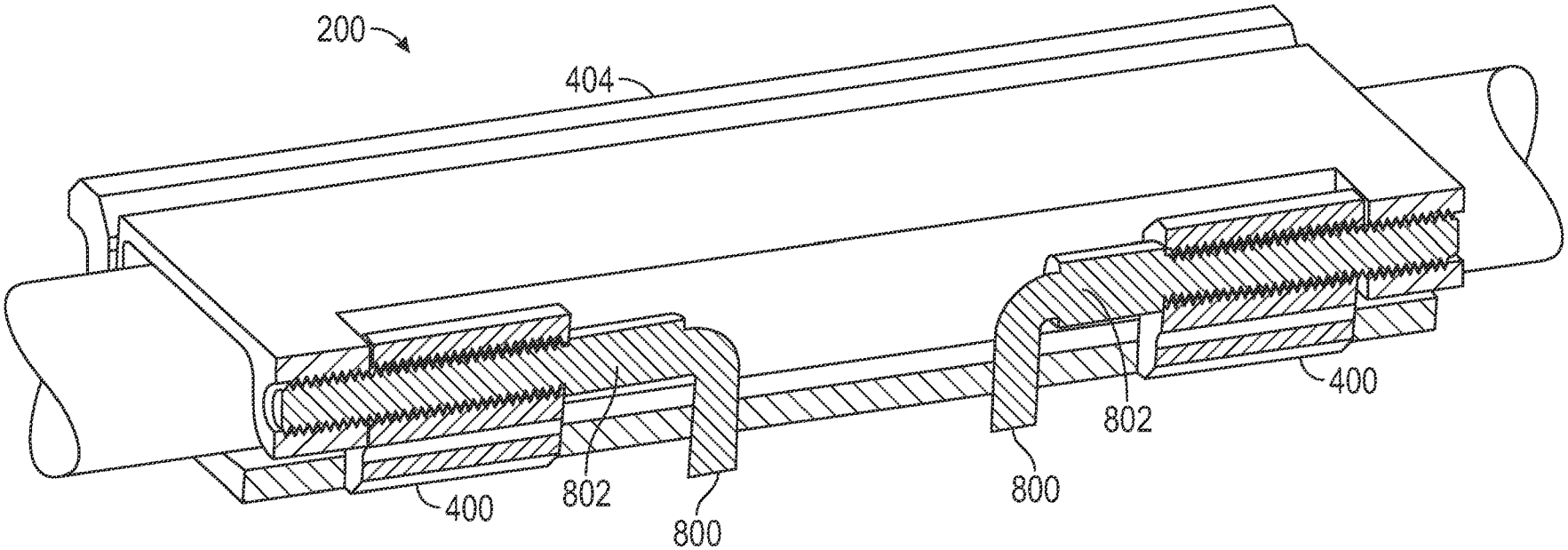
FIG. 8 is a side view of the clamp of FIG. 4 in the closed position.
Figure 9:
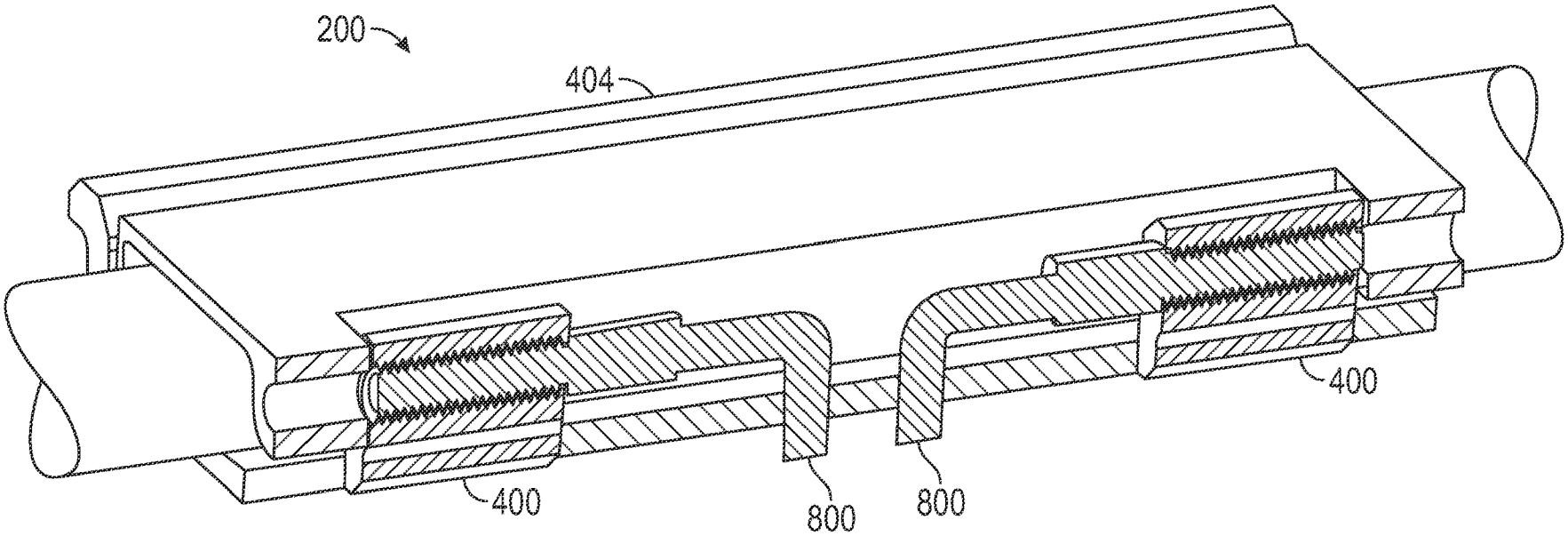
FIG. 9 is a side view of the clamp of FIG. 4 with the pins retracted.
Figure 10:
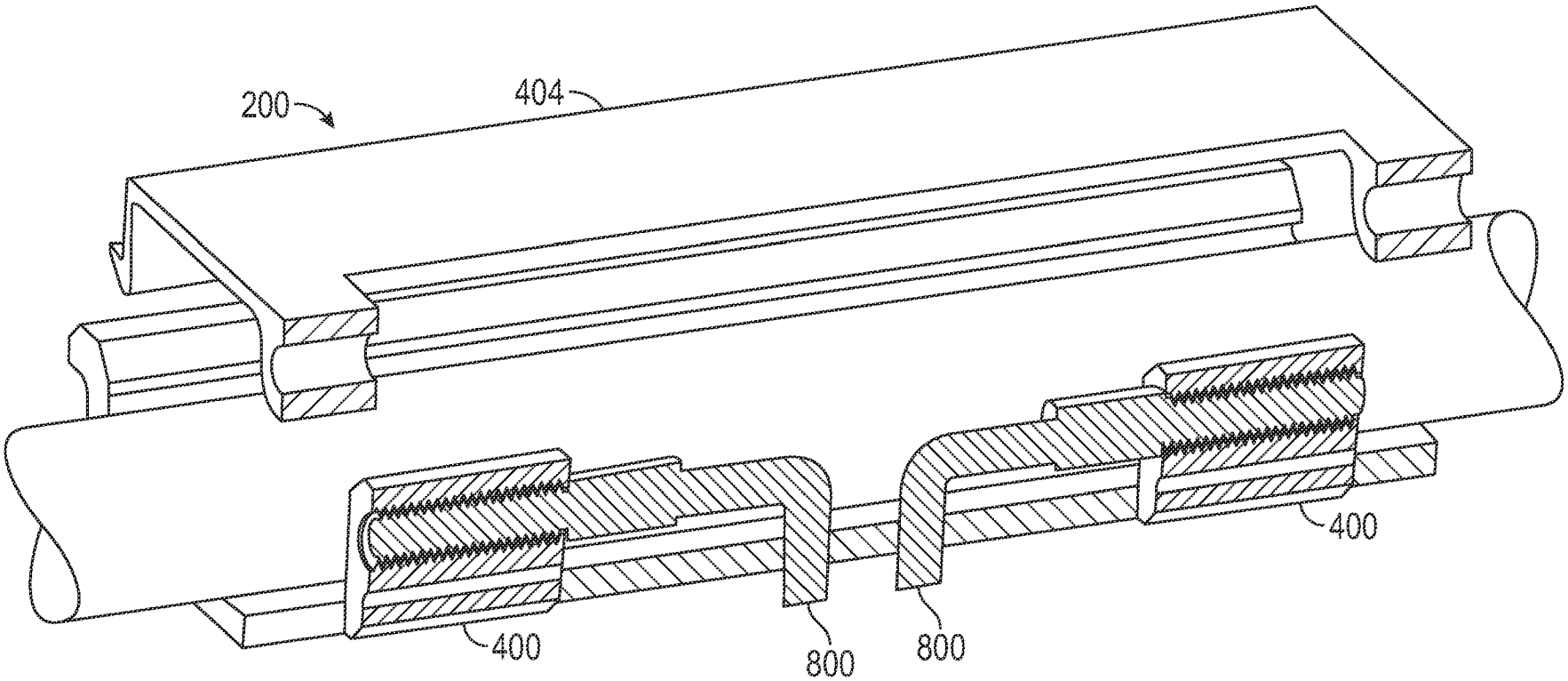
FIG. 10 is a side view of the clamp of FIG. 4 with the pins retracted and the lid removed.

In one or more embodiments, pins 800 biased in closed direction via springs 802 or similar mechanisms are used to removably couple the hinged end portion of the lid 404 to the base 400, as shown in FIGS. 8-10. In other embodiments, another removable securing mechanism may be used to couple the lid 404 to the base 400. The pins 800 are biased in the extended position to extend through the base 400 and into the lid 404, as shown in FIG. 8. Additionally, as shown in FIG. 8, the pins 800 may be biased in opposite directions. When a pressure is applied to the pins 800 in a direction opposite the bias direction, the pins 800 are retracted from the lid 404, as shown in FIG. 9. The lid 404 can then be removed from the base 400, as shown in FIG. 10. Removing the lid 404 allows control lines 204 to be removed from within the control line clamp 200.

As used herein, a range that includes the term between is intended to include the upper and lower limits of the range; e.g., between 50 and 150 includes both 50 and 150. Additionally, the term "approximately" includes all values within 5% of the target value; e.g., approximately 100 includes all values from 95 to 105, including 95 and 105. Further, approximately between includes all values within 5% of the target value for both the upper and lower limits; e.g., approximately between 50 and 150 includes all values from 47.5 to 157.5, including 47.5 and 157.5.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. A sand screen joint for use with a control line, the sand screen joint comprising:

a shroud having a channel extending longitudinally across the shroud; and a control line clamp coupled to the shroud and comprising:

a base having a profile that aligns with the channel of the shroud, the base further having a ratchet profile; and a lid that engages with the base to retain the lid in a closed position and to retain the control line within the control line clamp, the lid including a tooth profile that engages with the ratchet profile to retain the lid in the closed position.

2. The sand screen joint of claim 1, wherein the base further comprises a tooth profile that engages with the control line when the lid is in the closed position to at least one of support at least a portion of a weight of the control line or reduce axial movement of the control line.

3. The sand screen joint of claim 1, wherein the base is coupled to the lid via a removable pin.

4. The sand screen joint of claim 3, wherein the removable pin is biased in an extended position to couple the lid to the base.

5. The sand screen joint of claim 4, wherein the removable pin is biased via a spring.

6. The sand screen joint of claim 1, wherein the base is coupled to the lid via two removable pins, the removable pins biased in opposite directions to couple the lid to the base.

7. A completion system comprising:

a control line; and a sand screen joint comprising:

a shroud having a channel extending longitudinally across the shroud; and a control line clamp coupled to the shroud and comprising:

a base having a profile that aligns with the channel of the shroud, the base further having a ratchet profile; and a lid that engages with the base to retain the lid in a closed position and to retain the control line within the control line clamp, the lid including a tooth profile that engages with the ratchet profile to retain the lid in the closed position.

8. The completion system of claim 7, wherein the base further comprises a tooth profile that engages with the control line when the lid is in the closed position to at least one of support at least a portion of a weight of the control line or reduce axial movement of the control line.

9. The completion system of claim 7, wherein the base is coupled to the lid via a removable pin.

10. The completion system of claim 9, wherein the removable pin is biased in an extended position to couple the lid to the base.

11. The completion system of claim 10, wherein the removable pin is biased via a spring.

12. The completion system of claim 7, wherein the base is coupled to the lid via two removable pins, the removable pins biased in opposite directions to couple the lid to the base.

13. A method for completing a well, the method comprising:

positioning a control line within a channel of a shroud of a sand screen joint;

positioning the control line within a base of a control line clamp, the base having a profile that aligns with the channel of the shroud;

rotating a lid of the control line clamp to a closed position to retain the control line within the control line clamp, wherein a tooth profile of the lid engages with a ratchet profile of the base to retain the lid in the closed position; and running a completion comprising the sand screen joint into the well.

14. The method of claim 13, wherein retaining the control line within the control line clamp further comprises engaging the control line with a tooth profile of the base to at least one of support at least a portion of a weight of the control line or reduce axial movement of the control line.

15. The method of claim 13, further comprising coupling the lid of the control line clamp to the base of the control line clamp via a removable pin.

16. The method of claim 15, wherein coupling the lid of the control line clamp to the base of the control line clamp via the removable pin comprises biasing the removable pin in an extended position to couple the lid to the base.

17. The method of claim 16, wherein the removable pin is biased via a spring.

* * * * *